United States Patent [19]

Dixon

[11] 4,454,690

[45] Jun. 19, 1984

[54] PORTABLE AND OPERABLE WALL SYSTEM

[75] Inventor: Guy E. Dixon, Miami, Fla.

[73] Assignee: Panelfold, Inc., Miami, Fla.

[21] Appl. No.: 856,161

[22] Filed: Nov. 30, 1977

Related U.S. Application Data

[63] Continuation-in-part of Ser. No. 727,605, Sep. 28, 1976, Pat. No. 4,103,463, and a continuation-in-part of Ser. No. 770,064, Feb. 18, 1977, Pat. No. 4,277,920.

[51] Int. Cl.[3] ..... E06B 7/28; E04D 15/00

[52] U.S. Cl. ..... 52/126.3

[58] Field of Search ..... 52/126, 122, 127, 381, 52/241, 238, 126.3, 126.4; 249/316-321; 49/127, 321

[56] References Cited

U.S. PATENT DOCUMENTS

| | | | |
|---|---|---|---|
| 2,443,548 | 6/1948 | Wilson | 52/122 |
| 3,072,975 | 1/1963 | Burmeister | 49/317 |
| 3,295,257 | 1/1967 | Douglas | 49/127 |
| 3,327,439 | 6/1967 | Eatough | 52/238 |
| 3,341,992 | 9/1967 | Piper | 52/127 |
| 3,557,499 | 1/1971 | Dickie | 52/241 |
| 3,755,968 | 9/1973 | Williams | 49/488 |
| 4,034,524 | 7/1977 | Fromme | 52/122 |

FOREIGN PATENT DOCUMENTS

| | | | |
|---|---|---|---|
| 675016 | 7/1952 | United Kingdom | 52/238 |

*Primary Examiner*—John E. Murtagh

*Attorney, Agent, or Firm*—Harvey B. Jacobson

[57] ABSTRACT

A portable and operable wall system utlizing panels extending between a floor and ceiling with a channel-shaped member having seal means thereon along the top and/or bottom edge of the panel with at least one of the channel-shaped members being spring biased into engagement with the ceiling and/or floor to provide an effective, sound, light and air seal between the panels and the ceiling and floor.

7 Claims, 9 Drawing Figures

54
30
56
40
86
84
78
80
26
44
22
74
91
82
76
92
72
90
24
60
32
68
36
62

PORTABLE AND OPERABLE WALL SYSTEM

CROSS-REFERENCE TO RELATED APPLICATIONS

This application is a continuation-in-part of copending application Ser. No. 727,605, filed Sept. 28, 1976, for Portable Wall System, now U.S. Pat. No. 4,103,463 issued Aug. 1, 1978 and a continuation-in-part of Ser. No. 770,064, filed Feb. 18,1977, for Portable and Operable Wall Systems now U.S. Pat. No. 4,277,920.

BACKGROUND OF THE INVENTION

1. Field of the Invention

This invention relates to portable and operable wall systems of one or more movable panels disposed in a vertical position between a ceiling and floor. The portable wall system includes panels which are movable independently of any supporting connection with the ceiling and floor while the operable wall system includes panels which are movable while supported from a supporting surface, such as a trackway, or the like.

2. Description of the Prior Art

Wall systems having vertically disposed panels, partitions, room dividers, and the like, extending between a ceiling and floor are well-known with various structures being provided to retain the panels in place and to enable them to be installed and removed. The prior art made of record in the aforementioned parent applications illustrate various developments in this field of endeavor and is incorporated in this application by reference to the parent applications with the prior art including that cited by applicant and the prior art cited therein by the U.S. Patent and Trademark Office.

SUMMARY OF THE INVENTION

An object of the present invention is to provide a portable and operable wall system including a plurality of movable wall panels with each panel including a channel-shaped member along the bottom and/or top edge thereof with at least one of the channels being spring biased outwardly with the spring biased channel including adjustment means to maintain a constant spring bias exerted on the adjacent ceiling and/or floor to compensate for variations in the distance between the floor and ceiling, irregularities in the ceiling and floor and control the spring bias force exerted on the ceiling and floor to enable seal strips on the channel and/or channels to form an effective sound, light, and air seal.

In one embodiment of the invention, the portable wall system includes a spring biased channel along the top edge of each panel and an adjustable channel along the bottom edge of each panel with manually actuated means for retracting the upper channel and permitting upward movement thereof when installing and removing the panels with each of the channels including seal strips for sealing engagement with the ceiling and floor when the panels are installed.

In another embodiment of the invention, the operable wall system includes panels supported from an overhead trackway or other supporting surface with each panel including a channel along the upper edge thereof which is manually adjusted in relation to the top edge of the panel and the bottom edge of the panel is provided with a spring biased channel together with manually actuated means to retract the spring biased channel or permit it to expand downwardly to sealingly engage a floor.

In another embodiment of the operable wall system, the wall panels are supported from an overhead trackway or other supporting surface and the lower edge of each panel is provided with a manually adjustable channel and the upper edge of each panel is provided with a spring biased channel provided with manually actuated means to retract the spring biased channel and permit it to expand upwardly for sealing engagement with the ceiling.

In another embodiment of the operable wall system, the panels are supported from an overhead trackway or other supporting surface and a spring biased channel is provided along both the top and bottom edges of the panel with the lower channel including floor engaging support means and sealing strips to engage a floor surface. The top channel is provided with sealing strips engaged with a ceiling surface with the spring bias force exerted by both channels being adjustable and being sufficient to provide an effective sound, light, and air seal but yet enabling movement of the panels without manually retracting the spring biased channels.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 2:
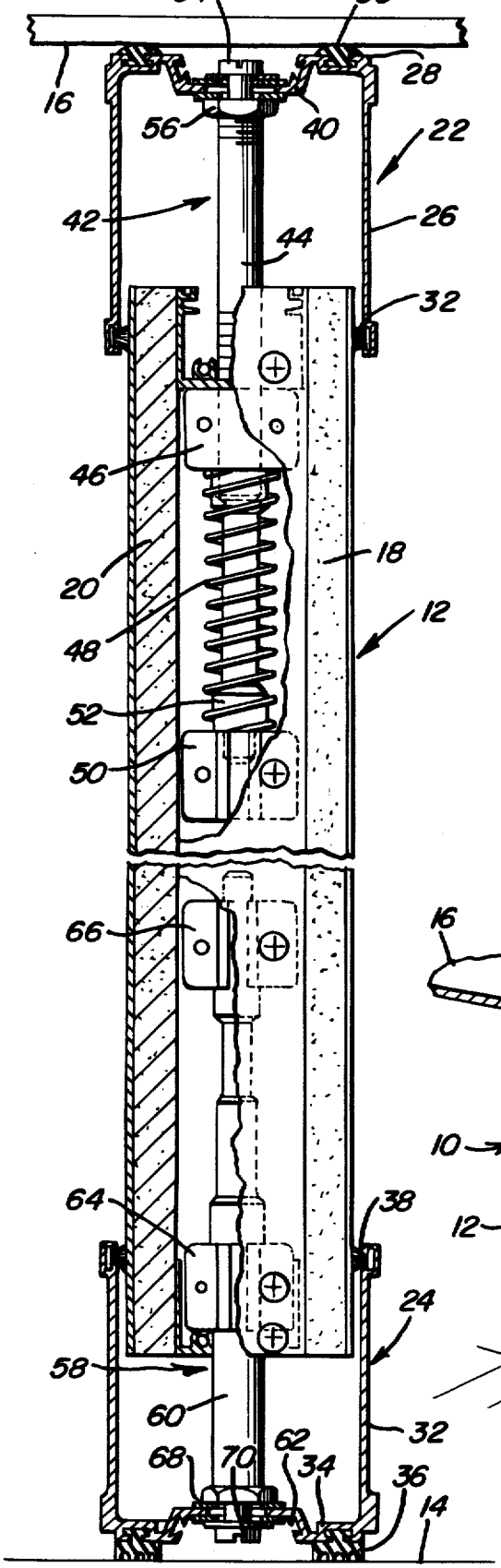
FIG. 2 is a vertical partial sectional view, on an enlarged scale, illustrating the structure of one of the panels with a spring biased channel along the top edge thereof and an adjustable channel along the bottom edge thereof.
Figure 4:
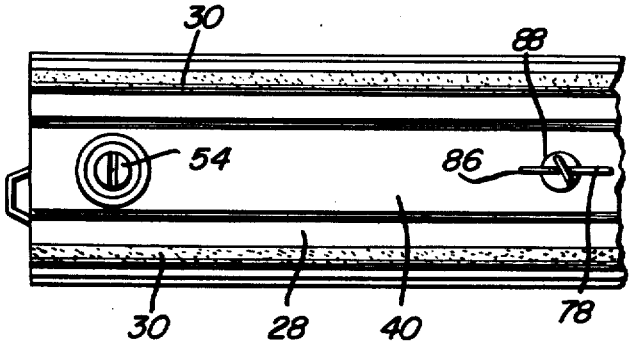
FIG. 4 is a fragmental top plan view of the construction of FIGS. 1 and 2 illustrating the manner in which the operating cable is attached to the spring biased channel.
Figure 5:
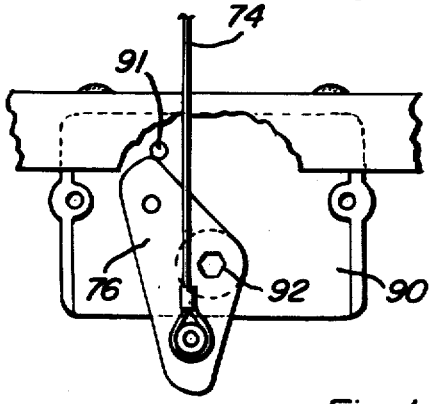
FIG. 5 is a fragmental view of the manually actuated means illustrating the position of the over-center lever when the spring biased channel is retracted.
Figure 1:
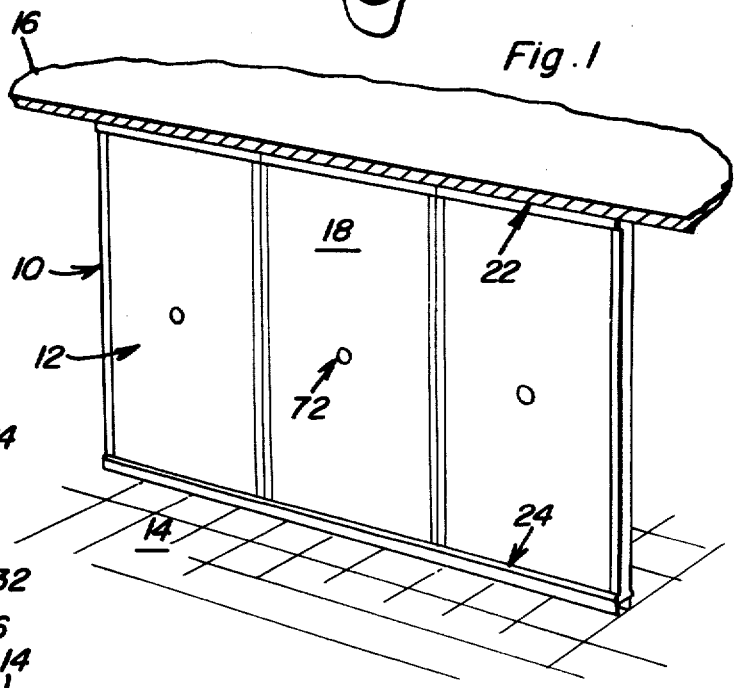
FIG. 1 is a perspective schematic illustration of a wall system illustrating vertically disposed wall panels extending between a ceiling and floor.

Referring now specifically to FIGS. 1-5 of the drawings, the portable wall system forming one embodiment of the present invention is generally designated by reference numeral 10 which includes a plurality of portable wall panels 12 oriented in vertical position with the side edges thereof interengaged or interlocked in any suitable manner to form a portable wall extending between a floor 14 and a ceiling 16 in order to provide an effective sound, light and air seal in an enclosure defined by vertical walls so that the enclosed space may be effectively divided into smaller enclosed spaces for various purposes. The panels 12 may be constructed of any standard size modules of various heights for installation in spaces having different heighth or width characteristics.

Each wall panel 12 is constructed in accordance with the disclosure in the aforementioned parent applications and includes a pair of rigid spaced panels 18 and 20 in fixed, spaced relation to each other by the usual peripheral frame.

Each panel 12 includes a generally U-shaped channel 22 at the upper edge thereof and a generally U-shaped channel 24 at the bottom edge thereof with the channel 22 being inverted and telescopically receiving the top edge of the panel 12 and the channel 24 telescopically receiving the bottom edge of the panel 12. The channel 22 includes spaced parallel legs 26 interconnected by a web 28 having a pair of laterally spaced, longitudinally extending seal strips 30 in sealing engagement with the ceiling 16. The inner surface of each of the legs 26 is provided with a seal strip 32 thereon in sealing engagement with the opposite surfaces of the panel 12. Likewise, the channel 24 includes a pair of spaced parallel legs 32 interconnected by a web 34 having a pair of longitudinally extending, laterally spaced sealing strips 36 thereon for sealing engagement with the floor 14. Each of the legs 32 is provided with a seal strip 38 on the inner surface thereof which sealingly engages the opposite surfaces of the panel 12 as illustrated in FIG. 2.

The web 28 of the channel 22 is provided with a downwardly offset central portion 40 which receives a guide assembly generally designated by numeral 42 therein in the form of an elongated rod 44 which is threaded and has an intermediate portion threaded into a floating nut 46 guided between the panels 18 and 20 and biased in an upward direction by a compression coil spring 48 having one end engaging the nut 46 and the other end engaging a fixed or stationary guide nut 50 with each of the nuts 46 and 50 including a projecting spring centering sleeve 52 thereon for retaining the spring properly positioned on the rod 44. The upper end of the rod 44 is reduced and extends through an opening in the web 40 of the channel 22 and is provided with a head 54 thereon having a screw driver receiving kerf, or the like, therein to enable the rod 44 to be threaded into or out of the floating guide nut 46, thus adjusting the initial position of the channel 22 with the spring 48 being such as to exert substantially a constant spring bias on the channel 22 throughout the range of expansion and contraction of the spring 48. A lock nut 56 is provided on the threaded rod 44 to lock it in rotatably adjusted position in relation to the floating guide nut 46 in order to retain it in adjusted position. The upper channel 22 will engage ceiling buttons (not shown) in the same manner as the portable wall system disclosed in the parent applications.

The lower channel 24 is provided with an adjustment assembly generally designated by numeral 58 and which includes a threaded rod 60 identical to the threaded rod 44 and connected to the offset 62 in the web 34 of the channel 24 in the same manner. The threaded rod 60 is threadedly engaged with a stationary guide nut 64 rigidly connected with the frame of the panel and the inner end of the threaded rod 60 is guided by a stationary guide nut 66. The structure of the nut 64 is the same as the nut 46 at the upper end of the panel except that it is fixed to the frame rather than floating and no spring is provided on the rod 60 at the lower end of the panel so that the channel 24 is manually adjusted by releasing the lock nut 68 and rotating the kerfed head 70 to manually adjust the initial position of the lower channel 24 after which the lock nut 68 is tightened to lock the threaded rod 60 in adjusted position. With this construction, the bottom channel 24 is initially adjusted so that the upper channel 22 will engage the ceiling 16 before the floating, threaded, guide nut 46 reaches its uppermost position against the upper frame member of the panel 12, so that the channel 22 will be spring biased into sealing engagement with the ceiling 16 thus spring biasing the seals 30 and 36, respectively, into engagement with the ceiling 16 and floor 14, respectively.

Figure 3:
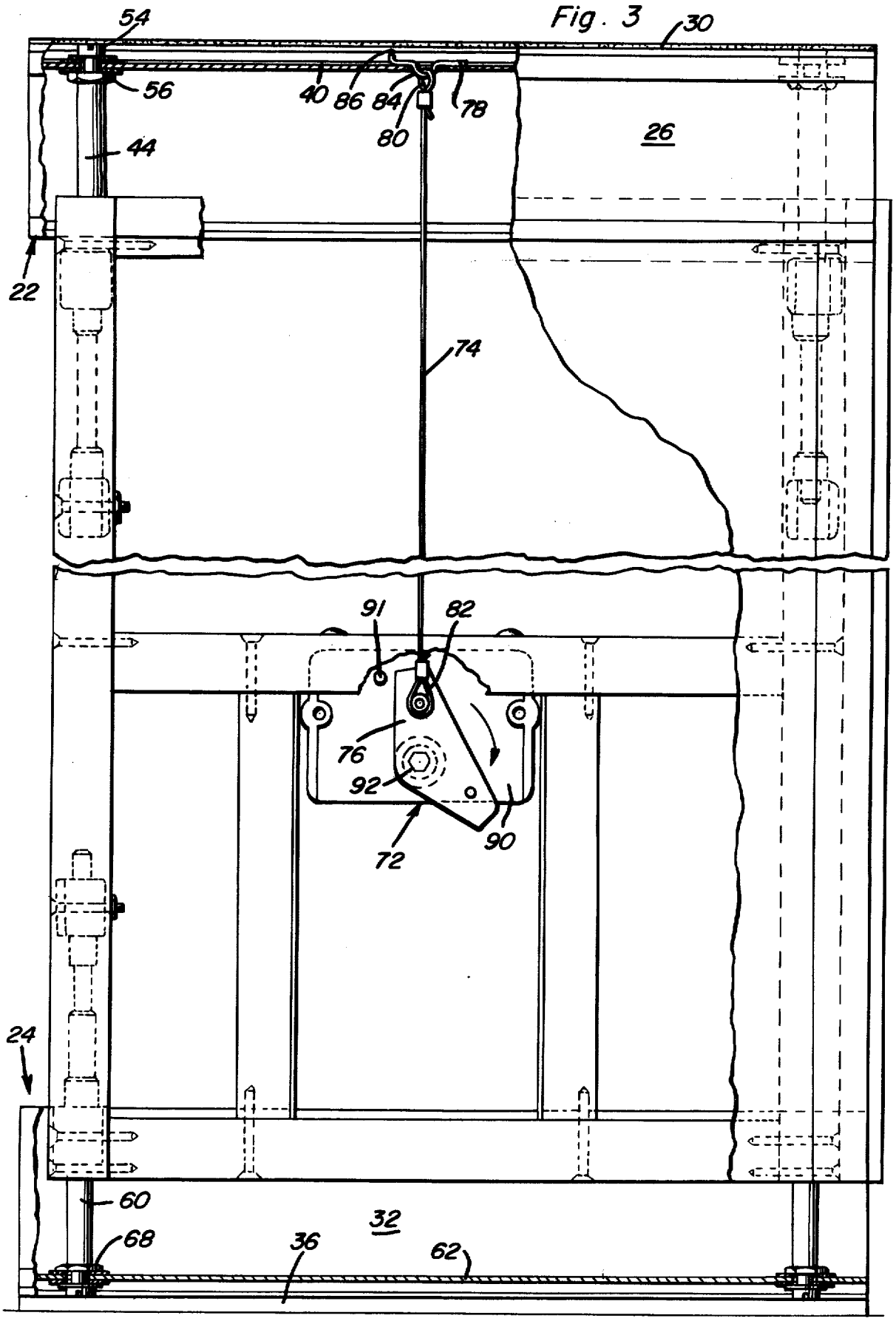
FIG. 3 is an elevational view of one of the panels, with portions broken away, illustrating the structural details of the mechanism for retracting the spring biased top channel.

In order to retract the channel 22, a manually actuated means 72 is provided adjacent the center of the panel 12 which includes an elongated flexible cable 74 having a lower end connected to a rotatable over-center lever or sector plate 76 and the upper end connected to an anchor member 78 disposed in the downwardly offset portion 40 of the channel 22, as illustrated in FIG. 3. The upper end of the cable 74 is provided with a loop 80 and the lower end of the cable is also provided with a loop 82 with the upper loop 80 being received on a depending offset portion 84 in the anchor 78. The anchor 78 includes a hook-shaped end 86 which facilitates connection of the loop 80 with the anchor 78 with the offset portion 84 depending through an aperture 88 in the web 40 of the channel 22. The over-center lever 76 is pivotally mounted on a support bracket 90 for rotational movement between the position of FIG. 3 in which the channel 22 is permitted to move upwardly to a position illustrated in FIG. 5 where the lever has been rotated to a position retracting the channel 22 thus compressing the springs 48 at which point one end of the lever 76 engages a stop pin 91 and the line of force exerted by the cable 74 has shifted to the opposite side of the rotational axis defined by a socket 92 or other means receiving a tool to enable the rotation of the lever by exerting rotational torque thereon with the lever 76 being cantilever supported to enable the cable 74 to pass over the center of rotation of the lever 76 so that it will be retained in both of its positions in the manner more specifically described in the aforementioned parent applications.

Figure 6:
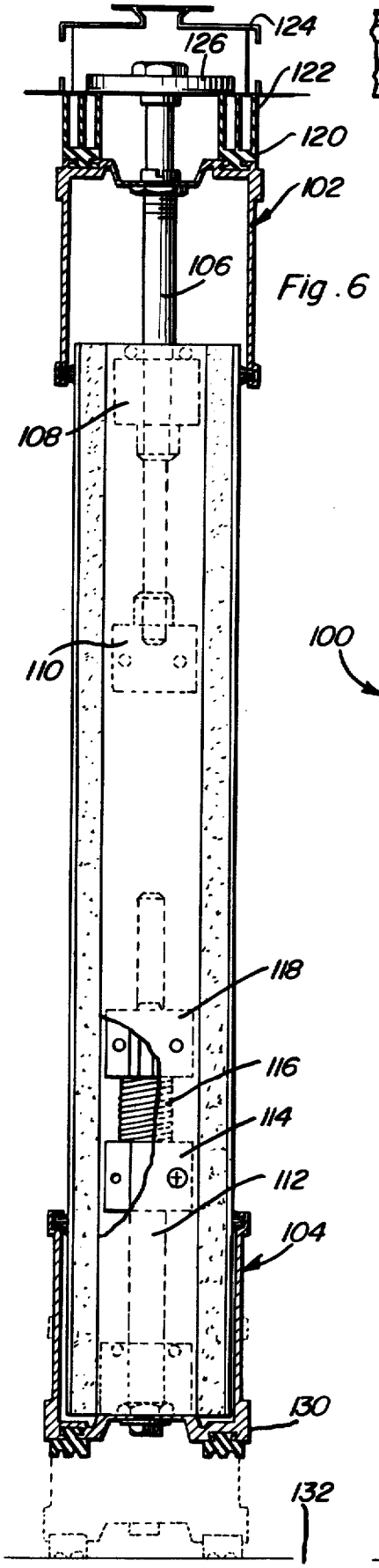
FIG. 6 is an end view of an operable wall system in which the top channel is adjustable and the bottom channel is spring biased.
Figure 7:
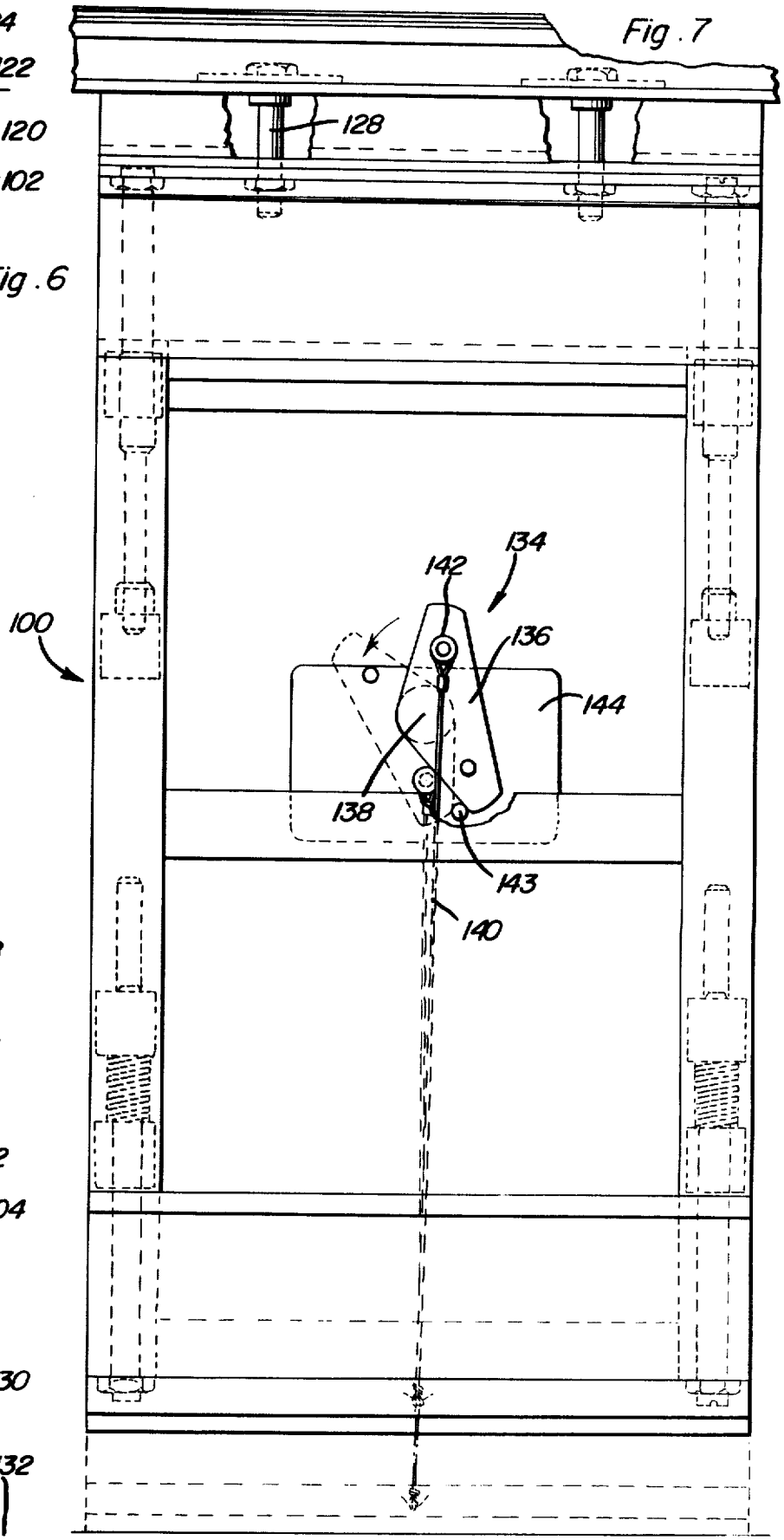
FIG. 7 is a side elevational view of the construction illustrated in FIG. 6 with portions broken away illustrating the manually actuated means for retracting the spring biased bottom channel.

Referring now specifically to FIGS. 6 and 7, the panel disclosed in this embodiment is designated by numeral 100 and the panel structure is the same as that illustrated in FIGS. 1-5. Also, an upper channel 102 and a lower channel 104 are provided with these channels being associated with the panel 100 in the same manner as the upper and lower channels in FIGS. 1-5. In this embodiment, the upper channel 102 is adjustable but not spring biased by a screw threaded rod 106 threadedly engaged with a stationary nut 108 secured to the panel 100 with the lower end of the rod 106 being slidable in a stationary guide nut 110. The lower channel 104 includes a threaded rod 112 threaded through a floating nut 114 that is biased downwardly by a coil spring 116 with the upper end of the rod 112 being slidable through a stationary guide nut 118. Thus, the channels, have, in effect been reversed as compared to FIGS. 1-5 in which the spring biased channel was at the top and the adjustable channel was at the bottom of the panel. In this embodiment, the upper channel 102 is provided with a seal strip 120 along each edge thereof having a plurality of relatively long flexible blades 122 for sealing engagement with an overhead track or ceiling structure with the track being designated by numeral 124 and receiving a generally horizontally disposed circular disc or puck 126 or any other suitable means for movably supporting the panels. The puck includes a depending support rod 128 forming a rotational axis for the puck 126 and being attached to the recessed central portion of the upper channel 102. The lower channel 104 is provided with seal strips 130 along each bottom edge thereof for engagement with the floor 132 with the seal strips 130 having relatively shallow grooves or ribs formed therein.

The lower channel 104 is retractable by a manually actuated device generally designated by numeral 134 and which includes a pivotal operating lever or sector 136 rotatable about an axis 138 and having a flexible cable 140 attached to a pin 142 adjacent one end thereof and the other end of the lever or sector 136 engaging a stop pin 143 on a mounting bracket 144 to retain the lever or sector 136 after the cable 140 has passed over the rotational center of the lever 136 and compressed the springs 116 to retract the bottom channel 104. Thus, the retracting mechanism for the bottom channel 104 in FIGS. 6 and 7 operates in the same manner and functions in the same manner as the manually actuated mechanism 72 in FIGS. 1-5, except that it retracts the spring biased bottom channel 104 so that the panel 100 can be moved along the supporting trackway when the lower channel 104 is retracted with the sealing blades 122 on the strip 120 serving as an effective seal but not increasing frictional resistance to movement to any appreciable degree. When the operable wall panel is positioned in a desired location, the manually actuated device 134 is rotated so that tension on the cable 140 is released and the springs 116 bias the bottom channel 104 downwardly into sealing engagement with the floor 132 with the seal strips 130 and the seal strips 120 on the respective channels serving to form an effective sound, light and air seal.

As an alternative, the operable wall system illustrated in FIGS. 6 and 7 may be constructed in the manner of the portable wall system illustrated in FIGS. 1-5 in which the upper channel is spring biased and the lower channel adjustable with the upper channel being retractable by the manually actuated mechanism at the center of the panel. Also, the spring biased upper channel would be supported from the overhead trackway in the same manner as illustrated in FIGS. 6 and 7. Thus, this alternative embodiment would, in effect, reverse the position of the upper and lower channels as illustrated in FIGS. 6 and 7 with the upper spring biased channel being supported from the pucks in the trackway and also being retractable and extendible by operation of the manually actuated mechanism. Thus, in this alternative arrangement, the bottom channel is lifted off the floor by pulling forwardly on the top channel. Various type of seal strips may be utilized depending upon the irregular or uneven conditions encountered in a particular installation and depending upon the sound, light and air sealing characteristics desired.

Figure 8:
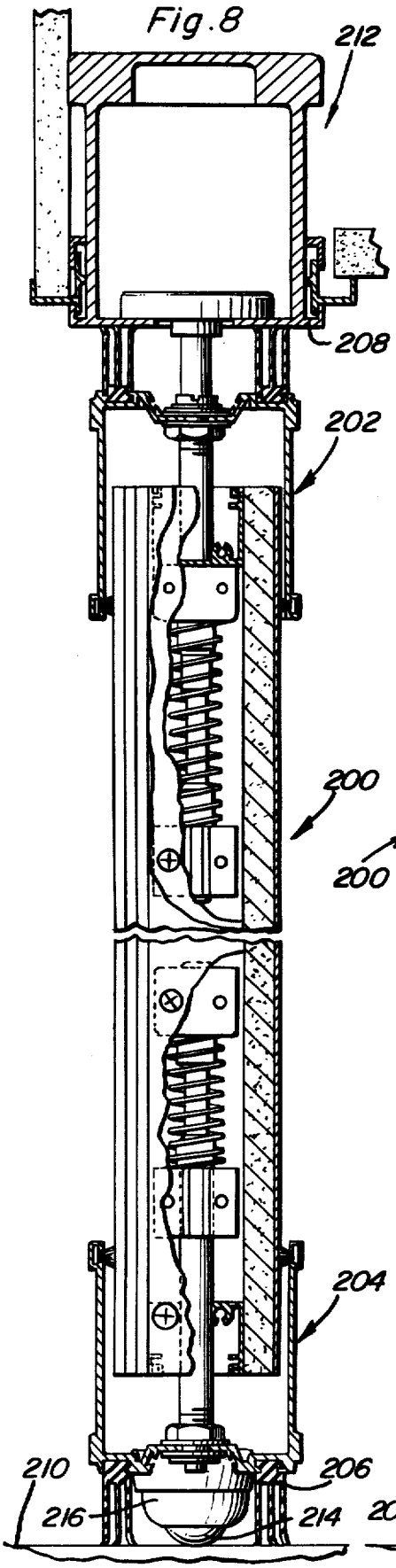
FIG. 8 is an end view, partially in section, illustrating an embodiment of the invention in which each panel is provided with a spring biased channel along the top and bottom edge thereof with the top channel being supported from an overhead trackway and the bottom channel including a floor engaging roller-type support.
Figure 9:
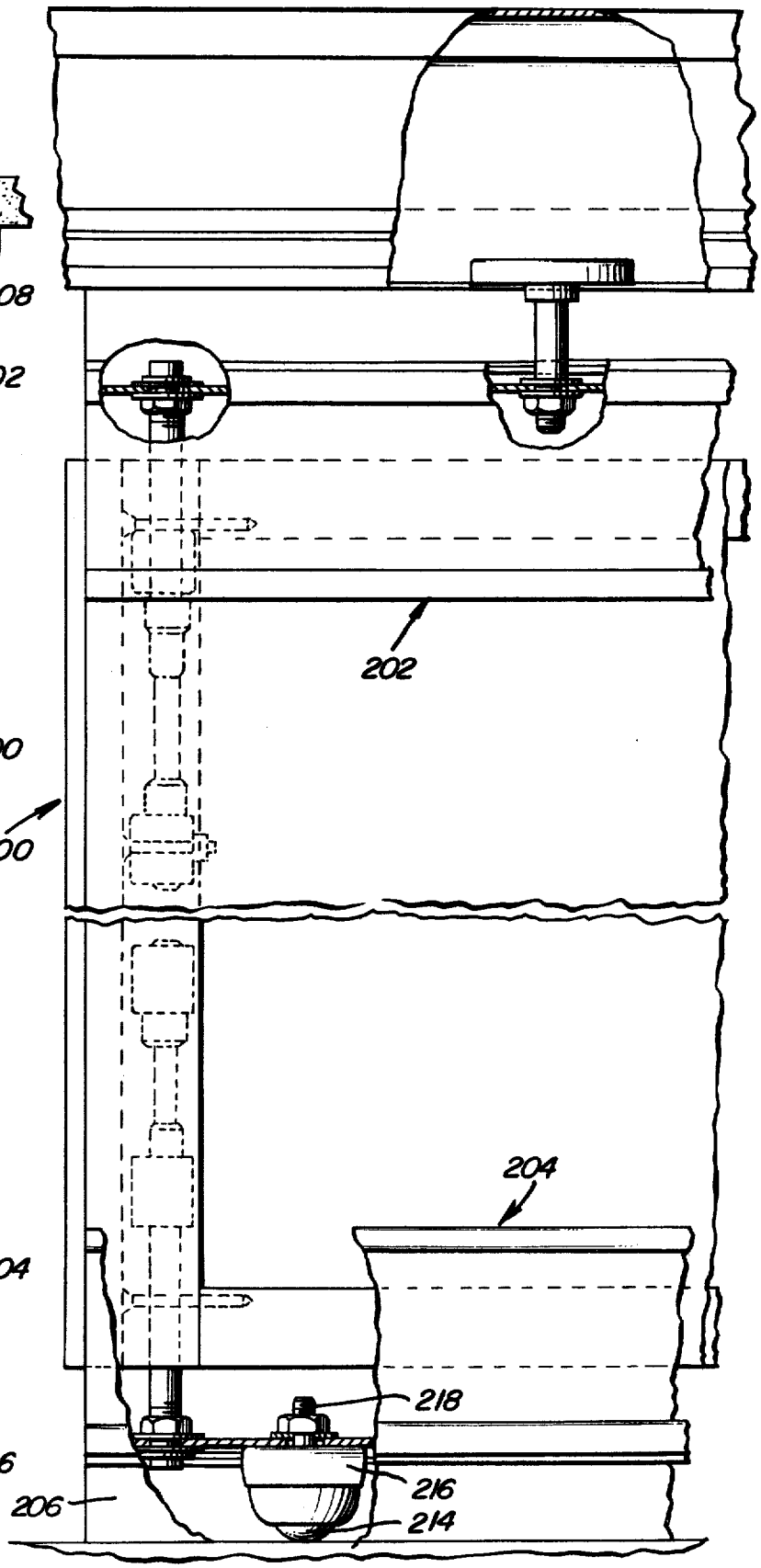
FIG. 9 is a side elevational view, with portions broken away, of the structure illustrated in FIG. 8.

FIGS. 8 and 9 illustrate another embodiment of the invention in which the panel is generally designated by numeral 200 and includes an upper spring biased channel generally designated by numeral 202 and a lower spring biased channel generally designated by numeral 204 which are duplicative of the spring biased channels disclosed in the other embodiments of the invention in which each channel is provided with a seal strip 206 along the edges thereof for engaging a track or ceiling surface 208 or a floor surface 210. In this embodiment of the invention, the upper spring biased channel 202 is supported from an overhead track and puck assembly 212 or any other suitable means in the same manner as the embodiment illustrated in FIGS. 6 and 7. Thus, in this embodiment, both the top and bottom channels are spring biased and neither of the channels are manually retractable. However, the lower channel 204 is provided with a ball-type caster 214 rotatably supported in a housing structure 216 that is connected to the recessed web portion of the lower channel 204 by a threaded stud and nut assembly 218 which is rigid with the housing 216 and extends through a suitable aperture in the web of the bottom channel 204, as illustrated in FIG. 9, thereby supporting the bottom channel 204 rollingly on the floor surface 210 with the seal strip 206 in sealing engagement with the floor 210. Thus, the two spring biased channels and the floor engaging roller cooperate to maintain the operable wall in sealed relationship to the floor and ceiling with the spring biased force exerted by the spring biased channels being substantially constant and enabling movement of the panels 200 to a desired position without retracting either of the channels by manually manipulating a retracting mechanism.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A panel positionable between a floor surface and an overhead surface comprising a rigid panel having top and bottom edges, a channel along the bottom edge of the panel for engaging the floor surface, and a channel along the top edge of the panel engaging the overhead surface, means resiliently biasing one of said channels vertically outwardly in relation to the panel for forming a sound, light and air seal at the top and bottom of the panel, said resilient biasing means including lengthwise compressible resilient means, means initially adjusting said vertically movable channel to a position just beyond its final position without changing the force exerted thereon by the resilient biasing means, both of said channels being vertically movable with at least one of said channels being resiliently biased outwardly of the panel, each of said channels including guide means connected with the panel for guided vertical movement in relation thereto, said guide means includes an elongated rod extending through and journaled in the channel, an outer portion of said rod being externally threaded and the inner portion thereof being externally smooth, a floating guide block screw threaded onto the threaded portion of the rod, floating block guide means in the panel for preventing rotation of the floating block but enabling vertical movement thereof, a stationery guide block in the panel in spaced relation to the floating guide block and including an aperture rotatably and reciprocally receiving the portion of the rod inwardly of the externally threaded portion thereof, said resilient biasing means including a compression coil spring encircling the rod and interposed between the stationary block and floating block to bias the floating block, rod and channel outwardly in relation to the panel, and means on said rod accessible exteriorly of the channel to enable rotatable adjustment of the threaded rod in relation to the floating block in order to adjust the initial position of the channel whereby compression of the spring will enable the channel to conform with variations in the floor-to-ceiling height with the initial adjustment of the channel enabling the force necessary to further compress the spring during movement of the channel to its final position to be a minimum and constant force, and manually actuated means selectively retracting the resiliently biased channel toward the panel and releasing the channel for outward movement.

2. The structure as defined in claim 1 wherein said resiliently biased channel is along the top edge of the panel.

3. The structure as defined in claim 1 wherein said resiliently biased channel is along the bottom edge of the panel.

4. The structure as defined in claim 1 wherein said manually actuated means includes a tension member connected to said resiliently biased channel, and means mounted on said panel and having said tension member connected thereto for exerting tension force on the tension member and resilient biased channel.

5. The structure as defined in claim 4 wherein said means having the tension member connected thereto is a rotatable lever mounted for limited rotation with the tension member shifting to opposite sides of the rotational axis with the resilient biasing means retaining the lever in both of its limited positions.

6. The structure as defined in claim 1 wherein said channel along the top edge of the panel includes upwardly extending support rods connected thereto, support means on the upper end of each rod for movable supporting engagement with an overhead supporting track whereby the panel is movably supported from said track.

7. The structure as defined in claim 1 wherein each of said channels includes parallel legs receiving opposite surfaces of the panel, said legs being interconnected by a web having laterally spaced longitudinally continuous seal strips thereon.

* * * * *